United States Patent [19]

Byler

[11] Patent Number: 4,799,347

[45] Date of Patent: Jan. 24, 1989

[54] INSULATION SUPPORT TRUSS

[76] Inventor: Eli A. Byler, 63968 Co. Home Rd., Lore City, Ohio 43755

[21] Appl. No.: 137,576

[22] Filed: Dec. 24, 1987

[51] Int. Cl.[4] ..... E04B 3/24

[52] U.S. Cl. ..... 52/712; 52/406; 52/407

[58] Field of Search ..... 52/406, 407, 404, 712

[56] References Cited

U.S. PATENT DOCUMENTS

| | | | |
|---|---|---|---|
| D. 29,071 | 7/1898 | Eldridge et al. | D8/356 |
| D. 195,180 | 5/1963 | Surratt | D8/356 |
| D. 206,401 | 12/1966 | Fisher | D8/356 |
| D. 254,534 | 3/1980 | Glynn et al. | D8/356 |
| D. 267,776 | 2/1983 | Holgersson et al. | D8/356 |
| D. 270,365 | 8/1983 | Hawl | D8/356 |
| D. 276,589 | 12/1984 | Tindell | D8/356 |
| 2,239,394 | 4/1941 | MacKechnie | 52/407 |
| 2,565,206 | 4/1951 | Day | 52/407 |
| 3,231,944 | 2/1966 | Bennett | 52/406 |
| 4,023,323 | 5/1977 | Fortin | 52/406 |
| 4,122,647 | 10/1978 | Kovar | 52/712 |
| 4,246,736 | 1/1981 | Kovar | 52/712 |
| 4,437,282 | 3/1984 | O'Brien | 52/40 |

*Primary Examiner*—Henry E. Raduazo

*Attorney, Agent, or Firm*—Jerry T. Kearns

[57] ABSTRACT

An insulation support truss is formed from a thin strip of spring steel. A V-shaped or trapezoidal notch is cut at each end of the strip and forms two pointed tips. In use, the support truss is snapped in place between two floor joists and serves to retain insulation between the joists. The insulation support truss of the present invention may be installed without the use of any tools, and alleviates the cumbersome and time consuming stapling of wire insulation supports between the floor joists. In a second embodiment of the present invention, a plurality of the insulation supporting trusses may be connected together by support slats. In a third embodiment of the present invention, the insulation support truss may be provided with transversely extending legs provided with a roughened surface for engagement with the sides of a floor joist. The insulation support truss is preferably formed from spring steel and may be provided in different lengths for use with different standard floor joist spacing dimensions.

8 Claims, 3 Drawing Sheets

INSULATION SUPPORT TRUSS

BACKGROUND OF THE INVENTION

1. Field of the Invention

The present invention relates to support trusses, and more particularly pertains to a new and improved support truss for retaining insulation between floor joists. When installing insulation between the floor joists of an existing building, it is necessary to crawl beneath the floor joists and insert insulation between the joists. Conventionally, chicken wire or wire strips are stapled between the floor joists to provide support for the insulation. Because of the confined area in the crawl space beneath the floor joists, this is a difficult and time consuming operation. In order to overcome this problem, the present invention provides an insulation support truss which may be snapped in place between floor joists without necessitating the use of any tools.

2. Description of the Prior Art

Various types of supporting struts and braces are known in the prior art. A typical example of such a support strut is to be found in U.S. Pat. No. Des. 29,071, which issued to H. Eldridge et al on July 19, 1898. This patent discloses a brace strip provided with flanged ends having apertures for the reception of fasteners. U.S. Pat. No. Des. 195,180, which issued to R. Surratt on May 7, 1963, discloses a bricklayer's line holder formed from an elongated flat strip provided with an integrally formed hook for receiving a chalk line. U.S. Pat. No. Des. 206,401, which issued to J. Fisher on Dec. 6, 1966, discloses a wire hanger formed as a thin flat strip provided with a curved cut out and an aperture adjacent one end thereof. U.S. Pat. No. Des. 254,534, which issued to J. Glynn et al on Mar. 25, 1980, discloses a roofing safety bracket formed from a thin metal strip bent into a V-shape and provided with a plurality of spaced apertures for the reception of nails. U.S. Pat. No. Des. 267,776, which issued to L. Holgersson et al on Feb. 1, 1983, discloses a mounting strip for electrical cables formed from an elongated strip having an open central channel. U.S. Pat. No. Des. 270,365, which issued to J. Hawk on Aug. 30, 1983, discloses an anchor post with an integral fastener for a flexible line. The device is formed from a cylindrical post having a pointed tip at one end and a curved wire loop secured adjacent an opposite end. U.S. Pat. No. Des. 276,589, which issued to B. Tindell on Dec. 4, 1984, discloses a gripper tie which is formed from an elongated strip provided with flat ridged plates adjacent opposite ends thereof.

While the above mentioned devices are suited for their intended usage, none of these devices provide a support truss suitable for the retention of insulation between spaced floor joists. Another feature of the present invention, not contemplated by the aforesaid prior art devices, is the provision of an insulation support truss which may be snapped in place between spaced floor joists without the use of any tools. Still another feature of the present invention is the provision of an insulation support truss provided with spaced pointed tips at each end thereof for engagement with side walls of floor joists. Inasmuch as the art is relatively crowded with respect to these various types of support trusses, it can be appreciated that there is a continuing need for and interest in improvements to such support trusses, and in this respect, the present invention addresses this need and interest.

SUMMARY OF THE INVENTION

In view of the foregoing disadvantages inherent in the known types of supporting trusses now present in the prior art, the present invention provides an improved insulation support truss. As such, the general purpose of the present invention, which will be described subsequently in greater detail, is to provide a new and improved insulation support truss which has all the advantages of the prior art support trusses and none of the disadvantages.

To attain this, representative embodiments of the concepts of the present invention are illustrated in the drawings and make use of an insulation support truss which is formed from a thin strip of spring steel. A V-shaped or trapezoidal notch is cut at each end of the strip and forms two pointed tips. In use, the support truss is snapped in place between two floor joists and serves to retain insulation between the joists. The insulation support truss of the present invention may be installed without the use of any tools, and alleviates the cumbersome and time consuming stapling of wire insulation supports between the floor joists. In a second embodiment of the present invention, a plurality of the insulation supporting trusses may be connected together by supporting slats. In a third embodiment of the present invention, the insulation support truss may be provided with transversely extending legs provided with a roughened surface for engagement with the sides of a floor joist. The insulation support truss is preferably formed from spring steel and may be provided in different lengths for use with different standard floor joist spacing dimensions.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved insulation support truss which has all the advantages of the prior art support trusses and none of the disadvantages.

It is another object of the present invention to provide a new and improved insulation support truss which may be easily and efficiently manufactured and marketed.

It is a further object of the present invention to provide a new and improved insulation support truss which is of a durable and realiable construction.

An even further object of the present invention is to provide a new and improved insulation support truss which is susceptible of a low cost of manufacture with regard to both materials and labor, and which accordingly is then susceptible of low prices of sale to the consuming public, thereby making such insulation support trusses economically available to the buying public.

Still yet another object of the present invention is to provide a new and improved insulation support truss which provides in the apparatuses and methods of the prior art some of the advantages thereof, while simultaneously overcoming some of the disadvantages normally associated therewith.

Still another object of the present invention is to provide a new and improved insulation support truss which may be snapped in place between spaced floor joists without the use of any tools.

Yet another object of the present invention is to provide a new and improved insulation support truss provided with a pair of spaced pointed tips at each end thereof for engagement with the side walls of floor joists.

Even still another object of the present invention is to provide a new and improved insulation support truss which may be formed in various predetermined lengths for use with different standard floor joist spacings.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
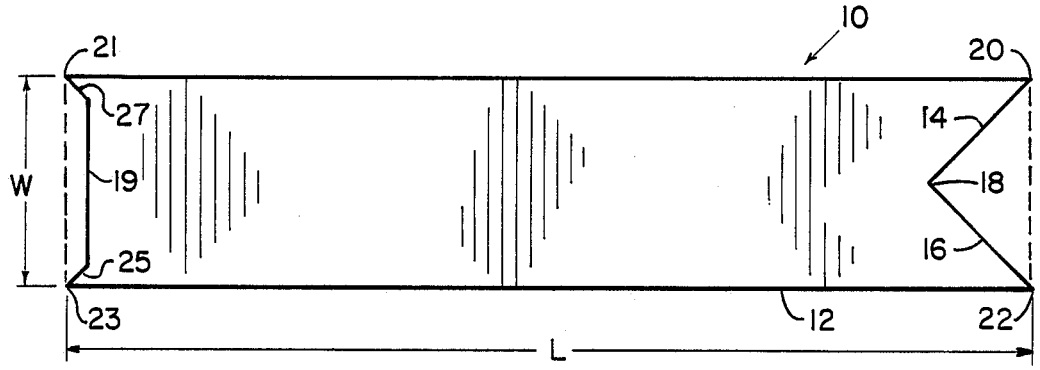
FIG. 1 is a top view of an insulation support truss according to a first embodiment of the present invention.

With reference now to the drawings, and in particular to FIG. 1 thereof, a new and improved insulation support truss embodying the principles and concepts of the present invention and generally designated by the reference numeral 10 will be described.

More specifically, it will be noted that the first embodiment 10 of the invention includes a flat elongated rectangular strip 12. The strip 12 is preferably formed from spring steel, but may be formed from a somewhat flexible plastic material. The spring steel strip 12 may be galvanized or painted to inhibit corrosion. The left and right hand ends of the strip 12 illustrate two different alternative constructions of the strip 12. Adjacent the left hand of the strip 12, a first alternative end construction is illustrated. A pair of pointed tips 21 and 23 are formed by making a trapezoidal cut out at the end of the strip. This trapezoidal cut out is illustrated by a dotted line. A pair of inclined walls 25 and 27 extend from the tips 23 and 21 and form an obtuse angle with a straight end wall 19. At the right hand end of the strip 12, a second alternative end construction is illustrated. A pair of pointed tips 20 and 22 are formed by making a V-shaped cut out, as illustrated by a dotted line, at the right hand end of the strip 12. Two inclined end walls 14 and 16 intersect at a central vertex 18. The strip 12 may be formed in a variety of different lengths, depending upon the floor joist spacing in the building where the insulation support truss is to be utilized. For example, for use with standard two by eight inch floor joists spaced sixteen inches on center, the strip 12 will have a length L of fifteen inches. For use with floor joists spaced at twenty four inches on center, the strip 12 will have a length L of twenty three and one quarter inches. In either case, the width W of the strip 12 will be approximately one and a half inches.

Figure 2:
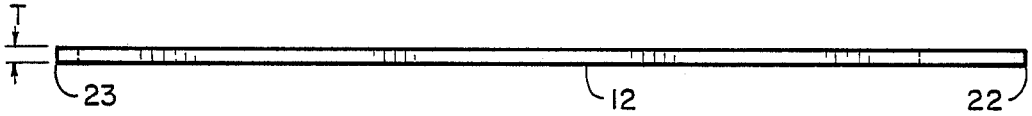
FIG. 2 is a side view of the insulation support truss according to the first embodiment of the present invention.

With reference now to FIG. 2, it may be seen that the strip 12 has a relatively small thickness of approximately one sixteenth of an inch. When spring steel is utilized for the strip 12, this thickness has been found to allow the required degree of flexibility, while at the same time maintaining sufficient rigidity for proper functioning of the insulation support truss 10.

Figure 3:
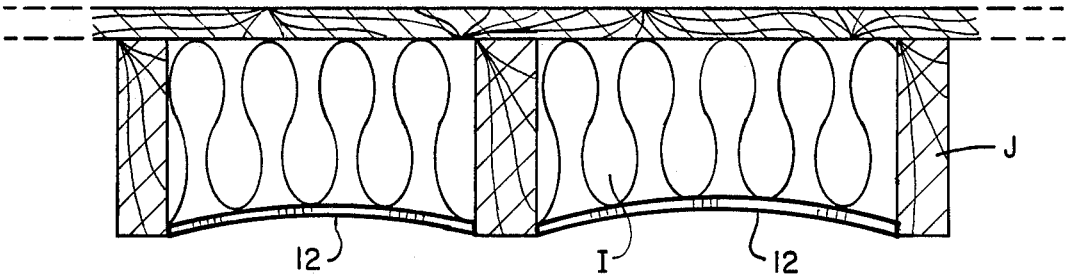
FIG. 3 is a side view, illustrating the manner of use of the insulation support truss of the first embodiment of the present invention.

In FIG. 3, a cross sectional side view is provided, illustrating the manner of use of the insulation support truss 10 of the first embodiment of the present invention. The slightly flexible strips 12 are snapped into place between two adjacent floor joists J. Due to the pointed tips at either end of the support truss 10, the strip 12 will be held in position. As illustrated, the support truss strip 12 will be bowed slightly upwardly, when properly installed. This upward bowing provides a support arch similar to the structure utilized in arched bridges. The insulation I will thus be retained securely in place between the adjacent floor joists J. Because the strips 12 may be snapped into place without the use of any tools, they may be conveniently utilized by carpenters in the cramped crawl space beneath the floor joists. The insulation support truss 10 of the first embodiment of the present invention may also be installed from above, during the construction of a new building. In either case, the insulation support truss may be quickly installed, without the cumbersome manipulation of conventional wire and stapling devices.

Figure 4:
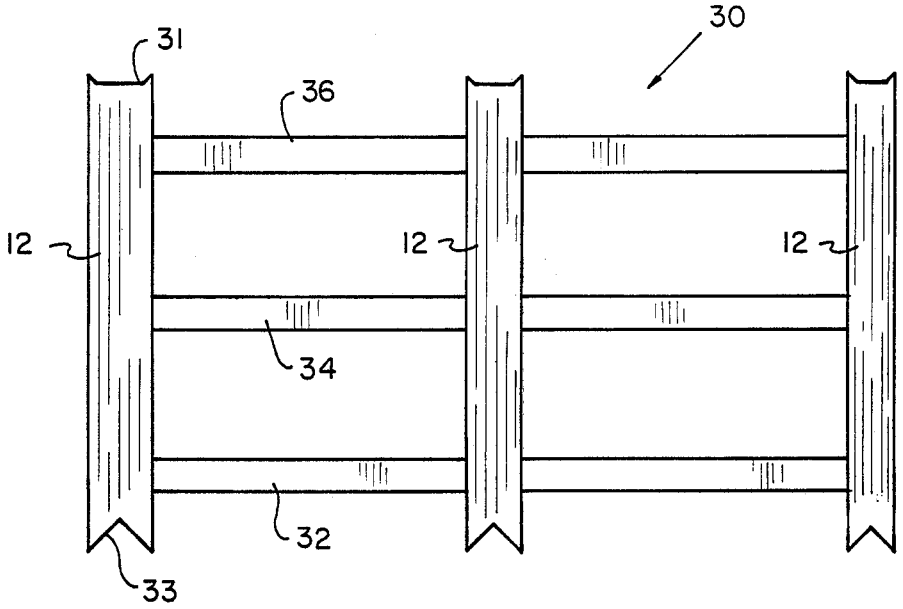
FIG. 4 is a top view of an insulation support truss according to a second embodiment of the present invention.

With reference now to FIG. 4, a second embodiment of an insulation support truss 30, according to the present invention, will now be described. A plurality of strips 12, formed in the manner described with reference to FIGS. 1 and 2, are connected by a plurality of transversely extending slats 32, 34 and 36. The transverse slats may be welded, riveted, clamped, adhesively secured or fastened by any other conventional technique to each of the strips 12. Each of the strips 12 may be provided with either of the two alternative end configurations illustrated at 31 and 33.

Figure 5:
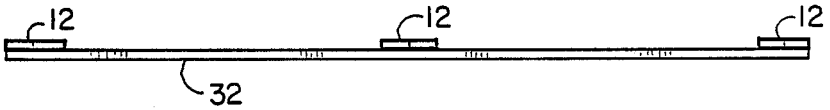
FIG. 5 is a side view of the insulation support truss of the second embodiment of the present invention.

In FIG. 5, a side view is illustrated which depicts the relative spacing and dimension of the strips 12 and transverse slat 32.

Figure 6:
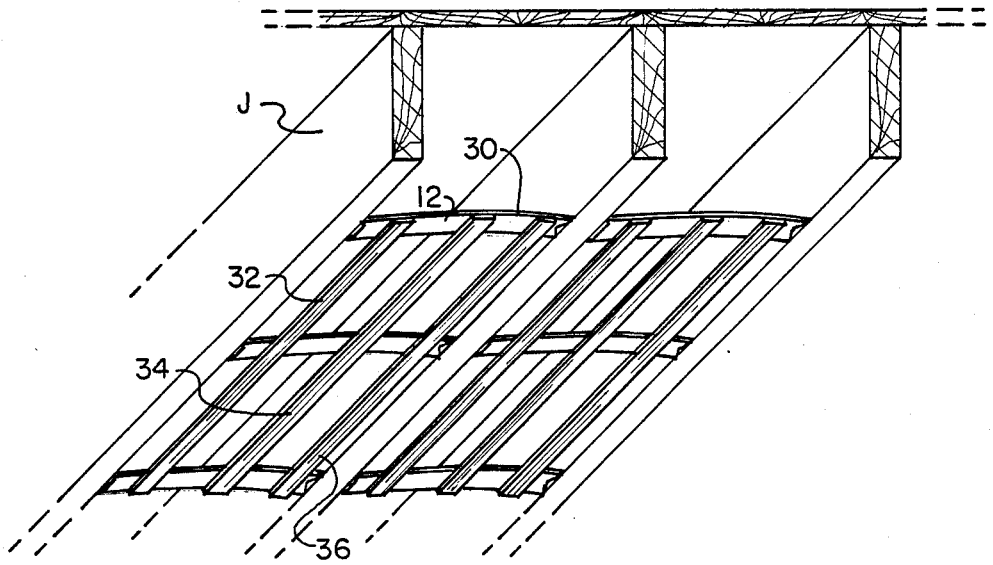
FIG. 6 is a perspective view illustrating the manner of use of the insulation support truss according to the second embodiment of the present invention.

With reference now to FIG. 6, a perspective view is provided, which illustrates the manner of usage of the insulation support truss 30 of the second embodiment of the present invention. The support truss 30 is snapped into place between two adjacent floor joists J. Insulation will then be securely retained between the joists J. The insulation will be supported transversely by the strips 12 and longitudinally by the slats 32, 34 and 36.

Figure 7:
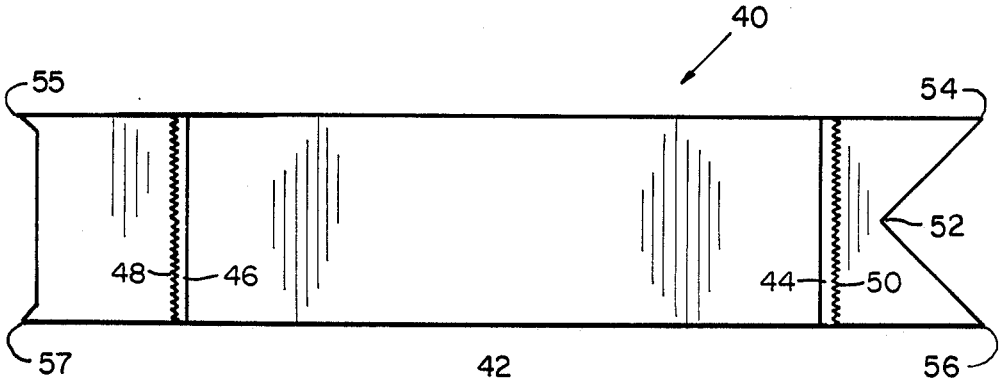
FIG. 7 is a bottom view of an insulation support truss according to a third embodiment of the present invention.

In FIG. 7, and insulation support truss 40, according to a third embodiment of the present invention, is illustrated. The insulation support truss 40 is formed from an elongated thin spring steel strip 42. The strip 42 is provided with a pair of spaced pointed tips 54, 56, 55 and 57 at each end thereof. Either of the tow alternative end constructions illustrated at the left hand side and the right hand side of the strip 42 may be utilized. A pair of upwardly extending legs 44 and 46 are provided on the strip 42. Each of the legs 44 and 46 are provided with an outwardly extending roughened surface 50 and 48 for engagement with the side wall of a floor joist.

Figure 8:
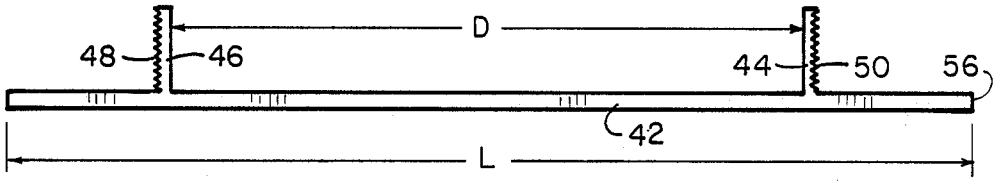
FIG. 8 is side view of the insulation support truss according to the third embodiment of the present invention.

In FIG. 8, a side view is provided, illustrating the upward extent of the legs 44 and 46. The length L of the strip 42 is about twenty three and one fourth inches. The distance D between the legs 44 and 46 is about fifteen inches. By this construction, the truss 40 may be utilized with either sixteen inch on center spaced joists or twenty four inch on center spaced joists. When utilized with twenty four inch spaced joists, the pointed tips at each end of the strip 42 will engage the side walls of the joists. When utilized with sixteen inch spaced joists, the roughened sides 48 and 50 of the legs 46 and 44 will engage the side walls of the joists. The legs 44 and 46 may be formed as separate elements secured in any conventional manner to the strip 42, or may be economically formed by stamping out and bending portions of the strip 42.

Figure 9:
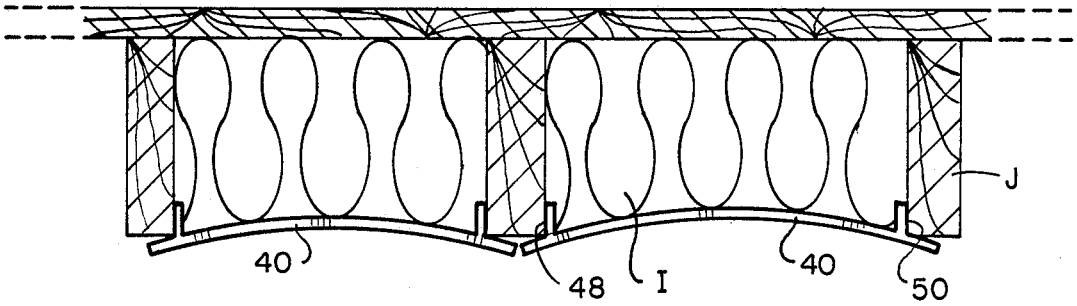
FIG. 9 is a side view illustrating the manner of use of the insulation support truss of the third embodiment of the present invention.

With reference now to FIG. 9, the manner of using the insulation support truss 40 according to the third embodiment of the present invention will now be described. If the floor joists J are spaced sixteen inches on center, as illustrated, the roughened surfaces 48 and 50 of the upstanding legs 46 and 44 engage the side walls of the floor joist J, thus securing the insulation I in place. If the floor joists J are spaced twenty four inches on center, the pointed ends of the truss 40 may be engaged with the side walls of the floor joists J in the manner illustrated in FIG. 3. Thus, by the provision of the upstanding legs 44 and 46 at appropriate locations on the strip 42, the support truss 40 is suitable for use with floor joists of two different standard spacings.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A new and improved insulation support truss for insertion between floor joists with either of two different standard floor joist spacings, comprising:

thin elongated strip means formed from a flexible material;

said strip means having a length slightly greater than the larger of the two different standard floor joist spacings;

pointed tip means at opposite ends of said strip for engagement with side walls of the floor joists;

a pair of spaced legs transversely connected to said strip means;

said legs spaced apart a distance slightly greater than the smaller of the two different standard floor joist spacings; and said legs each having a roughened outer surface.

2. The insulation support truss of claim 1, wherein said flexible material comprises spring steel.

3. The insulation support truss of claim 1, wherein said pointed tip means is formed by a trapezoidal cut out at each end of said strip; and each of said points having an inclined wall which forms an obtuse angle with an end wall of said strip means.

4. The insulation support truss of claim 1, wherein said pointed tip means is formed by a V-shaped cut out at each end of said strip; and each of said pointed tips having an inclined wall which intersect at a central vertex.

5. The insulation support truss of claim 1, wherein said strip means has a width of about one and a half inches.

6. The insulation support truss of claim 1, wherein said strip means has a thickness of about one sixteenth of an inch.

7. The insulation support truss of claim 1, further comprising a plurality of said strip means extending in spaced parallel relation; and a plurality of spaced parallel slats transversely secured to each of said strip means.

8. The insulation support truss of claim 1, wherein said strip means has a length of about twenty three and one fourth inches and said upwardly extending legs are spaced apart about fifteen inches on said strip means.

* * * * *